United States Patent [19]

Vana

[11] 4,328,682

[45] May 11, 1982

[54] HEAD PRESSURE CONTROL INCLUDING MEANS FOR SENSING CONDITION OF REFRIGERANT

[75] Inventor: John H. Vana, Allentown, N.J.

[73] Assignee: Emhart Industries, Inc., Farmington, Conn.

[21] Appl. No.: 150,787

[22] Filed: May 19, 1980

[51] Int. Cl.[3] ..... F25B 41/00; G01K 13/00

[52] U.S. Cl. ..... 62/196 B; 62/129; 62/149

[58] Field of Search ..... 62/DIG. 17, 199, 149, 62/196 B, 129, 509; 165/22

[56] References Cited

U.S. PATENT DOCUMENTS

| | | | |
|---|---|---|---|
| 2,286,961 | 6/1942 | Hanson | 417/316 X |
| 2,564,310 | 8/1951 | Nussbaum et al. | 62/DIG. 17 |
| 3,145,544 | 8/1964 | Weller | 62/85 X |
| 3,151,470 | 10/1964 | Quick | 62/152 X |
| 3,839,877 | 10/1974 | Kramer | 62/129 X |
| 3,905,202 | 9/1975 | Taft et al. | 62/152 |
| 3,933,197 | 1/1976 | Zimmer et al. | 165/22 X |
| 4,009,825 | 3/1977 | Coon | 165/22 |
| 4,136,528 | 1/1979 | Vogel et al. | 62/174 |
| 4,167,858 | 9/1979 | Kojima et al. | 62/129 X |
| 4,235,095 | 11/1980 | Liebermann | 73/19 |

*Primary Examiner*—William E. Wayner

*Attorney, Agent, or Firm*—Frederick A. Zoda; John J. Kane; Albert Sperry

[57] ABSTRACT

A sensing device detects "flashing" in a refrigerant liquid line, upstream from the expansion valves of the evaporators of a refrigeration system. In response, a valve opens in a line extending between the compressor discharge line and a receiver, to bypass discharge vapor into the receiver, thus raising the head pressure to an extent sufficient to satisfy the requirement for a steady liquid refrigerant flow at the expansion valve. The head pressure is raised only to the minimal extent necessary to satisfy this requirement. Disclosed is a sensor of the type incorporating a sight glass in the path of a beam extending between photoelectric cells, though other sensing devices of an equivalent nature can be used. The invention can comprise a single sensing device in the liquid line extending to one or more evaporators connected in parallel. Alternatively, one may utilize separate sensing devices, one for each of several evaporators connected in parallel, with each sensing device having the capability of operating the valve, thus to assure a minimal but sufficient head pressure within the liquid line sufficient to maintain a liquid refrigerant seal at the expansion valve where flashing has been detected by its associated sensor.

7 Claims, 2 Drawing Figures

HEAD PRESSURE CONTROL INCLUDING MEANS FOR SENSING CONDITION OF REFRIGERANT

BACKGROUND OF THE INVENTION

1. Field of the Invention

The invention relates, in general, to refrigeration systems, especially those of the commercial type used in the refrigeration of display cases in supermarkets or similar establishments. In a more particular sense, the invention has reference to automatic controls utilizing an element or elements sensitive to an undesirable condition developing in a refrigerant, and effective under these circumstances to automatically elevate head pressure to a value that overcomes the sensed condition.

2. Description of the Prior Art

In a commercial refrigeration system of the type used in supermarkets or similar establishments, the condition known as "flashing" develops, not infrequently, in the liquid line extending from the condenser to one or more evaporators incorporated in the system. Desirably, a liquid seal, that is, refrigerant in a completely liquid state, should exist at the expansion valve of each evaporator of the system. Maintenance of the liquid seal prevents the "starving" of the expansion valve associated with each evaporator, that is to say, each evaporator should be supplied continuously with a steady flow of liquid refrigerant if it is to operate at peak efficiency. The existence of a vapor-liquid combination at the expansion valve results in a consequent, often serious reduction in the level of operating efficiency.

Heretofore, it has been proposed to increase the operating efficiency of the evaporators by prevention or minimizing of flashing and the starving of expansion valves. For example, U.S. Pat. No. 4,167,102 to Willitts, issued Sept. 11, 1979 and owned by the assignee of the present application, discloses means for preventing starving of the evaporators in a refrigeration system in which a saturated gaseous refrigerant is utilized for defrost purposes. And, in Willitts application Ser. No. 022,583 filed Mar. 21, 1979, now U.S. Pat. No. 4,231,229 also owned by the assignee of the present application, a means for controlling receiver pressures is disclosed, having among other purposes the prevention of starving of the expansion valves.

These devices are fully efficient for their intended applications, especially in that they attack and solve problems in systems utilizing a reverse flow of gaseous refrigerant ("hot gas", "cool gas", or a combination thereof). However, the present invention approaches the problem of flashing of the refrigerant and starving of the expansion valves in a different way. Hence, the present invention solves similar problems in a way that permits it to be used to advantage in systems in which the controls of the prior art do not function with an equivalent efficiency.

SUMMARY OF THE INVENTION

Summarized briefly, the invention is particularly designed to permit the head pressure to drop, at the inlet side of a conventional thermostatic expansion valve of an evaporator, until flashing (that is to say, a vapor-liquid combination) manifests itself at that location. In accordance with the invention, the presence of flashing at the inlet of the expansion valve is thereupon instantly detected by a device sensitive to this condition. The sensing device responds by operating a valve provided in a bypass line between the compressor discharge and the receiver of the system, to produce a flow of discharge gas into the receiver, thereby raising the head pressure in the area of the valve. The flow of the discharge gas to the receiver, and the raising of the head pressure from the value at which it permitted flashing to occur, continues only to the extent necessary to restore a liquid seal at the expansion valve inlet, that is to say, only so long as the flashing of the refrigerant persists. Upon restoration of the liquid seal at the location of the expansion valve, the sensing device acts to cut off the bypassing of the discharge gas to the receiver. In this way, the head pressure at the location of each expansion valve is maintained at a minimal value effective to maintain the desired liquid seal on the inlet side of each and every expansion valve. Maintaining the head pressure at this minimal but efficient value acts to prevent starving of the expansion valve, while at the same time acting to decrease power consumption and increase the capacity of the compressor or compressors utilized in the refrigerating system.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENTS

Figure 1:
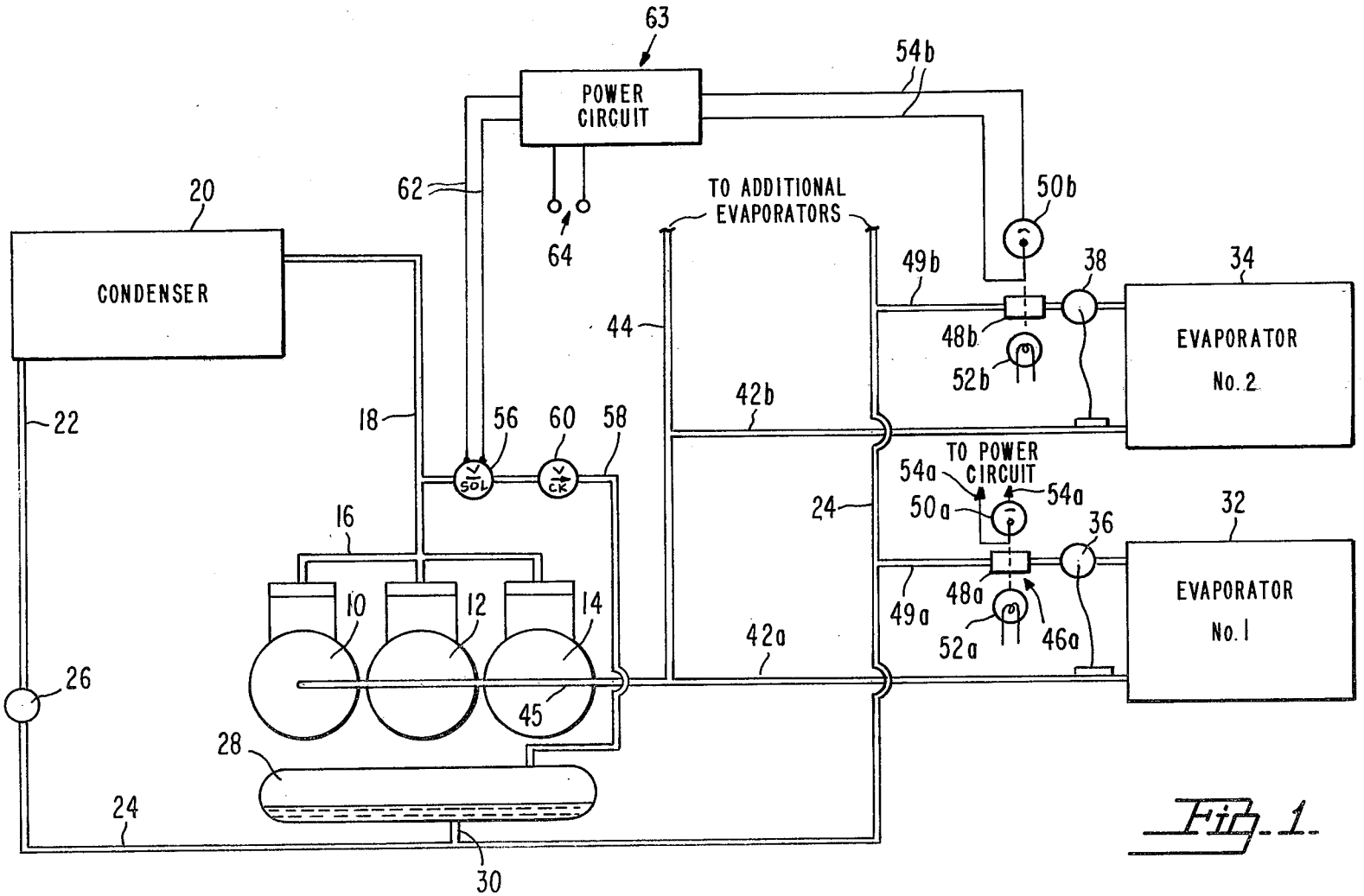
FIG. 1 is a schematic representation of a refrigerating system utilizing the automatic head pressure control means constituting the present invention, there being a separate sensing device for each evaporator of the system.

The invention is used to advantage in typical commercial refrigeration systems, such as those used to refrigerate display cases in supermarkets or similar business establishments. Thus, and referring to FIG. 1, there is illustrated by way of example a refrigerating system including a plurality of compressors 10, 12, 14 connected in parallel to discharge compressed gaseous refrigerant through a common header 16 into a hot gas discharge line 18 to a condenser 20 desirably cooled by ambient air, and of sufficient capacity to condenser the entire output of the three compressors. Condenser 20 delivers liquid refrigerant through a condenser drain line 22, and liquid line 24, through a pressure responsive valve 26. A surge receiver 28 communicates at its bottom with liquid line 24, through a connecting line 30.

Liquid line 24 is connected to a series of evaporators connected in parallel, as shown at 32, 34. The evaporators are provided at their inlet ends with expansion valves 36, 38 respectively. Refrigerant entering the evaporators through the expansion valves from the liquid line flows back to the compressors through return lines 42*a*, 42*b* which are in communication with a common return header 44 communicating with suction line 45 common to the several compressors.

The invention is not limited to a system utilizing multiple compressors and/or multiple evaporators. It may be employed advantageously in systems utilizing one or more compressors, as well as one or more evaporators. Typically, however, a commercial installation in a supermarket will be as shown, utilizing a multiplicity of compressors connected in parallel, and a bank of evaporators which, in the same system, would also be in parallel.

Figure 2:
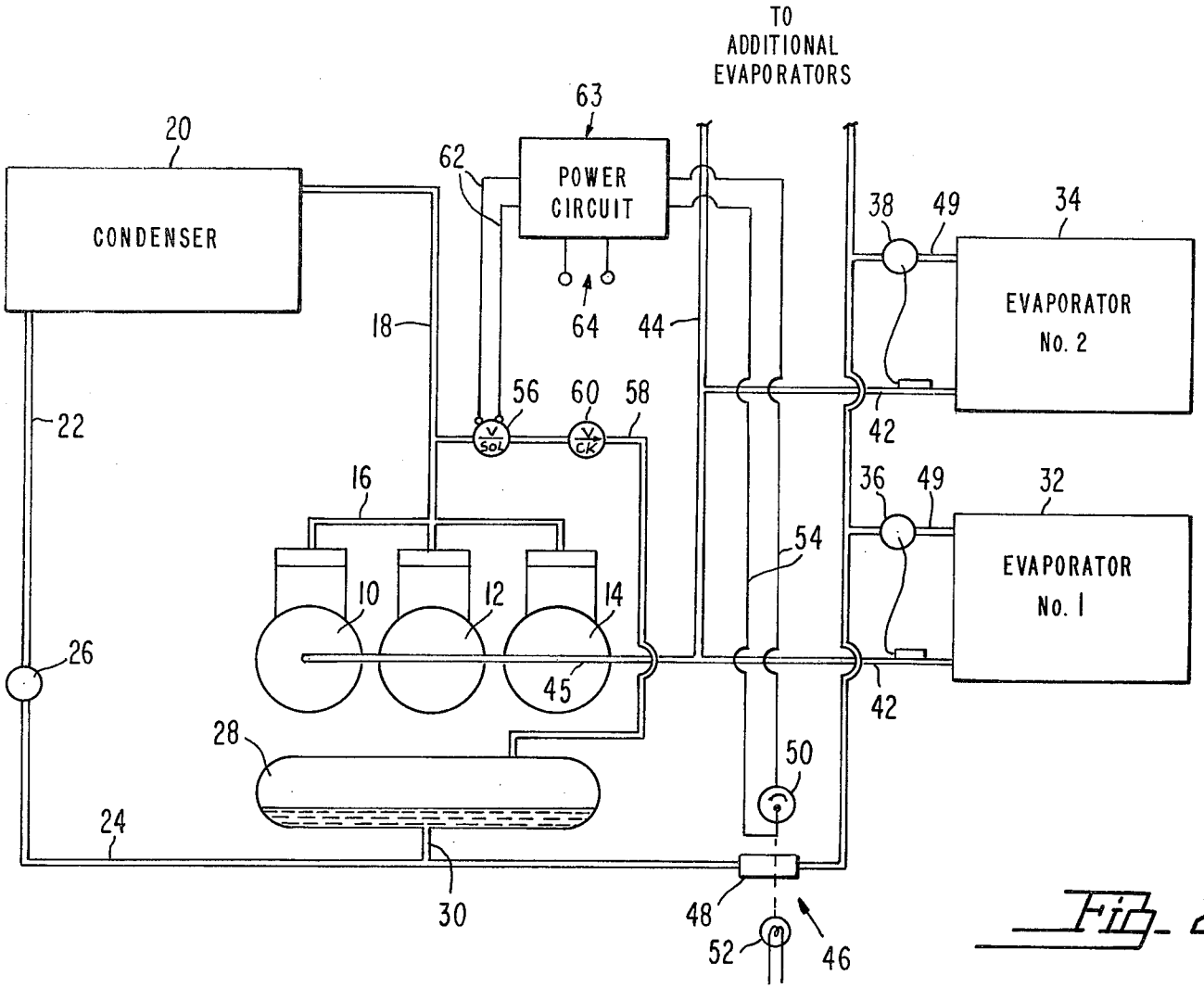
FIG. 2 is a schematic representation of a refrigerating system in which a single sensing device is common to the several evaporators of the system.

The improvement comprising the present invention has been generally designated 46 in FIG. 2 and in the presently preferred embodiment illustrated in FIG. 1, has been generally designated 46*a*.

In the FIG. 1 embodiment of the invention, separate sensing devices 48*a*, 48*b* have been mounted to sense the condition of liquid refrigerant entering the evaporators 32, 34 respectively through evaporator inlet lines 49*a*, 49*b*.

The sensing devices, in the illustrated embodiment, comprise sight glasses, which are mounted directly in the respect evaporator inlet lines. Liquid refrigerant flowing to the expansion valves thus passes through the sight glasses, immediately upstream of the respective expansion valves.

The refrigerant, at this location, is desirably in a fully liquid form, to provide a solid column of liquid at the inlet to each thermostatic expansion valve, that is to say, a liquid seal at each valve location.

Maintenance of the liquid seal at the location of each expansion valve is, however, not always achieved during the normal operation of a refrigerating system of the character illustrated and described. In particular, flashing takes place at one or more expansion valves, not infrequently. When this happens, the integrity of the liquid seal is broken, in that instead of a solid column of liquid being presented to the expansion valve, there is, instead, a vapor-liquid combination.

The refrigerant, when the condition known as flashing occurs, loses its normal clarity, that is to say, from a condition in which it has the visual characteristics of clear water, it volatilizes to a cloudy appearance and will reflect any light ray directed toward it.

At this point, it may be noted that there can be additional evaporators, as well as additional sensors associated with the additional evaporators, as illustrated schematically in FIG. 1. For the purposes of the present disclosure, however, the invention will be described as though there were only two evaporators and two associated sensing devices, one for each of them.

Designated at 56 is a conventional solenoid valve, which controls flow through a line 58 communicating between the compressor discharge line 18 and the top of the surge receiver 28. Between the surge receiver and the solenoid valve, there is provided in the present instance a conventional check valve 60. This is arranged to prevent any flow from the receiver to the compressor discharge line, in the event the receiver pressure should exceed that in the compressor discharge line in a situation in which the solenoid valve 56 happens to be open.

Electrical circuits in which the operation of equipment of devices, in this case the solenoid valve 56, is controlled by means of one or more phototubes, are in and of themselves notoriously old and well known. These so-called "electric eye" circuits are thus illustrated in a very basic, schematic way herein. In FIG. 1, sight glasses 48*a*, 48*b* are respectively disposed in positions to intercept light beams directed from light sources 52*a*, 52*b* to phototubes 50*a*, 50*b* respectively. The phototubes are separately connected by leads 54*a*, 54*b* respectively to a conventional power circuit 63, connected to a source of electrical power 64 and controlling the operation of the solenoid valve 56 through leads 62. In the typical "electric eye" power circuit, the signal resulting from the action of light impressed upon the cathode of the phototube is amplified within the typical electric eye power circuit shown, to operate a relay or the like within the power circuit, to control the flow of current from the power source 64 to the solenoid 56.

Referring to evaporator 34 by way of example, if refrigerant is flowing through the sight glass 48*b* in a fully clear, liquid condition, maintaining a good liquid seal at the expansion valve 38, there is no interruption of the light beam between light source 52*b* and phototube 50*b*. In these circumstances, the phototube is energized to impress a signal on the power circuit 63 illustrated in FIG. 1. Assume the valve 56 is of the type in which it is normally closed when de-energized. The appropriate relay or other equivalent means of circuit 63 in this event may be normally energized in the presence of the signal from phototube 50*b*, to hold the circuit open between the source of power and the solenoid.

This would be the normal, efficient operation in a condition in which there is no flashing at the inlet side of any of the expansion valves. In these circumstances, the head pressure is high enough, within the liquid line 24 and hence in the evaporator inlet lines 49*a*, 49*b*, to maintain a good liquid seal at the expansion valve locations. There would thus be no reason to artificially maintain the head pressure at these locations any higher than necessary to maintain a good seal and, consequently, good and efficient operation of the evaporators.

If the head pressure should fall, no problems result at the location of the expansion valves unless and until the pressure falls to the point where it produces liquid flashing within one or more of the sight glasses. When this happens, as indicated above, the solenoid valve is opened immediately and by causing the flow of hot gas from the discharge line 18 into the receiver, produces added pressure upon the liquid within the receiver and hence upon the liquid refrigerant flowing through the liquid line 24 and the evaporator inlet lines. The valve remains open, and the head pressure within the liquid line rises, only to the extent necessary to eliminate the flashing condition and restore the desired condition in which there is a solid column of liquid at the inlet side of the affected expansion valve or valves.

The connection of the phototubes to the power circuit would, of course, in FIG. 1 be such as to cause the solenoid valve to be opened when flashing is detected in any of the evaporator inlet lines. It is not necessary that flashing occur in all the lines before the valve opens.

In FIG. 2, a single sight glass 48 is in the path of a beam of light between light source 52 and phototube 50 connected by leads 54 to the power circuit 63. In this instance a single sight glass controls flashing for all the evaporators and can be located anywhere in the liquid line 24 upstream from the evaporator or evaporators to which the liquid refrigerant flows through the liquid line.

In the illustrated examples, the sensing means has been illustrated as a sight glass, light source, and phototube. However, the invention contemplates the use of other sensing devices operative to detect the existence of a flashing of the liquid refrigerant. For example, U.S. Pat. No. 4,138,879 issued Feb. 13, 1979 discloses a detector for use in a refrigerating system, adapted to detect the existence of bubbles in a liquid coolant. The detecting device as shown in that patent could be used advantageously in place of the phototube and sight glass and the disclosure in that patent, in reference to the detecting device itself and the amplifying circuit associated therewith, is incorporated by reference in the present disclosure, as a means that can be substituted for the phototube and the conventional amplifying circuit used therewith in a manner effective to produce a response in a power circuit for controlling operation of the solenoid valve.

In a working embodiment of the invention, it may be possible to eliminate the conventional condenser flooding valve 26, since the head pressure control derives directly from sensing of the refrigerant condition at its critical point, that is to say, the point at which it enters the expansion valve or valves of the system. Many systems also include receiver pressure controlling valves of the type disclosed, for example, in Taft et al U.S. Pat. No. 3,905,202 owned by the assignee of the present application. Whether one or more of these presently known valves can be dispensed with may depend, of course, upon the extent or complexity of the particular system, the environment in which it is located, and upon other conditions including, for example, sizing of the piping, and the number and capacity of the evaporator, compressors, and the condenser. In other words, while the present invention has real value in producing efficient operation with a minimum expenditure of energy for operation of the compressors, and with minimum loss of compressor capacity, no claim is made that it will in every instance permit elimininating of the receiver pressure control valve arrangements and/or the pressure responsive valve 26 now mounted in the liquid line to control condenser flooding.

It is also believed that in order to keep the solenoid valve from opening and closing too rapidly, a time delay circuit may be required to lock the solenoid valve in its open conditon for perhaps five or ten seconds after the sight glass has cleared and has indicated once again the presence of a solid column of liquid at the affected expansion valve. Such circuits are well known in the art as means for controlling solenoid valves.

It is also though that a receiver pressure regulator may be advisable, in series with the solenoid valve 56, to keep the receiver pressure from rising too rapidly, and to act as a fail-safe, in the event of the possible failure of the valve 56 to operate normally.

It is believed mainly important to note that the invention comprehends substantially instantaneous detection of a fishing condition in the supply of liquid refrigerant present to one or more expansion valves of the refrigerating system, and an automatic response to such detection comprehending the opening of a flow of hot gas from the compressor discharge line to an area of the receiver, in which the gas dumped into the receiver will exert an internal pressure within the receiver effective to elevate the head pressure in the liquid line to that extent needed for the purpose of restoring a solid column of liquid and a good liquid seal at the affected expansion valve. The invention further comprehends permitting head pressure within the liquid line to float downwardly—as distinguished from maintaining it at an artificially preselected level—until flashing occurs, at which point the disclosed automatic response is effected to raise the head pressure only to the extent necessary to eliminate the flashing condition. This leaves the head pressure at the lowest value, at the location of the expansion valves, to which it can safely descend without breaking the integrity of the liquid seal at the location of the expansion valves.

While particular embodiments of this invention have been shown in the drawings and described above, it will be apparent that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. In a refrigerating system essentially including at least one each of the following; namely, a compressor, a condenser, a surge receiver having top and bottom portions, and an evaporator, and in which there is a compressor gas discharge line that extends from the compressor to the condenser, a refrigerant supply line through which refrigerant, bypassing the receiver, flows directly from the condenser to the evaporator, a connecting line extending from the bottom of the receiver to the refrigerant supply line, a head pressure control line connected between the top portion of the receiver and the compressor discharge line, an expansion valve in the refrigerant supply line, and a refrigerant return line extending from the evaporator to the compressor, the improvement comprising:

(a) a sensing device for detecting flashing of the refrigerant in the refrigerant supply line upstream from the expansion valve, said sensing device, in the absence of flashing, normally being in a non-operating mode, said device switching to a second, operating mode upon but not before the occurrence of said flashing;

(b) normally closed valve means connected in the head pressure control line to control flow therethrough, said valve means being opened by the sensing device upon operation thereof to its second position, for dumping gas from the compressor gas discharge line into the top portion of the receiver through the head pressure control line to increase the head pressure in the refrigerant supply line means responsive to the detection of the flashing, said valve adapted to remain open only for that period of time necessary to elevate the head pressure in the refrigerant supply line means sufficiently to eliminate the flashing condition.

2. In a refrigerating system the improvement of claim 1 wherein the valve is electrically controlled and the sensing device is adapted to produce an electrical control signal effective to govern operation of the valve.

3. In a refrigerating system the improvement of claim 2 in which there is a power circuit electrically connected with the valve, a source of electrical power, and the sensing device, adapted to amplify the signal from the sensing device and control of power from said source to the valve as a response to said amplification.

4. In a refrigerating system the improvement of claim 1 in which there is a plurality of evaporators, there being a single detecting device upstream from at least one of said evaporators.

5. In a refrigerating system the improvement of claim 4 in which the refrigerant supply line comprises a liquid line extending from the condenser and comprising the portion of the refrigerant supply line that communicates with the receiver, and a plurality of evaporator inlet branch lines extending from the liquid line to the several evaporators, the detecting devices being mounted in the respective branch lines.

6. In a refrigerating system the improvement of claim 4 in which each sensing device, upon detecting flashing within the branch line in which it is mounted, is individually adapted to control the means for dumping gas into the receiver from the compressor discharge line.

7. In a refrigerating system the improvement of claim 1 in which there is a plurality of evaporators, there being a separate detecting device for each of said evaporators.

* * * * *

UNITED STATES PATENT AND TRADEMARK OFFICE

CERTIFICATE OF CORRECTION

PATENT NO. : 4,328,682

DATED : May 11, 1982

INVENTOR(S) : John H. Vana

It is certified that error appears in the above-identified patent and that said Letters Patent are hereby corrected as shown below:

Column 3, Line 18, change "respect" to --respective--

Column 5, Line 43, change "though" to --thought--

Column 5, Line 50, change "fishing" to --flashing--

Column 5, Line 51, change "present" to --presented--

Column 6, Line 57, after "control" insert --the flow--

Signed and Sealed this

*Twenty-seventh* Day of *March 1984*

[SEAL]

*Attest:*

GERALD J. MOSSINGHOFF

*Attesting Officer*

*Commissioner of Patents and Trademarks*